United States Patent [19]

Pollak

[11] 4,154,273

[45] May 15, 1979

[54] HAMMER

[76] Inventor: I. Scott Pollak, 14 Greenway Rd., Armonk, N.Y. 10504

[21] Appl. No.: 869,060

[22] Filed: Jan. 13, 1978

[51] Int. Cl.[2] ..... B25C 1/00; B25D 1/00

[52] U.S. Cl. ..... 145/29 R; 145/36

[58] Field of Search ..... 145/29 R, 36, 2 R; 254/26 R

[56] References Cited

U.S. PATENT DOCUMENTS

| | | | |
|---|---|---|---|
| 684,098 | 10/1901 | Regan | 145/2 R |
| 1,242,307 | 10/1917 | Babson | 145/29 R |
| 1,515,142 | 11/1924 | Butler | 254/26 R |
| 2,919,613 | 1/1960 | Crement | 145/29 R |
| 4,038,719 | 8/1977 | Bennett | 145/61 L |

FOREIGN PATENT DOCUMENTS

| | | | |
|---|---|---|---|
| 21725 | 12/1916 | Denmark | 145/29 R |
| 18073 | 8/1904 | Sweden | 145/2 R |
| 349939 | 12/1960 | Switzerland | 145/29 R |

*Primary Examiner*—James L. Jones, Jr.
*Assistant Examiner*—J. T. Zatarga
*Attorney, Agent, or Firm*—John J. Hart; Charles E. Baxley

[57] ABSTRACT

A hammer having a rigid handle composed of an inner portion generally disposed at an angle of 35° to the striking face of the hammer head and an outer portion generally disposed at an angle of 130° to the inner handle portion. The outer end of the outer handle portion is spaced a distance of two inches from a plane containing said striking face and is hooked to provide a protective blocking element for the user's hand.

1 Claim, 3 Drawing Figures

HAMMER

The Invention

This invention relates to an improved hammer having features which are of especial advantage in the practice of carpentry although it may be used to equal advantage in other fields employing hammers.

The customary carpenter's hammer is composed of a straight handle disposed at right angles to the hammer head and attached to a central portion of the hammer head between the striking portion and claws thereof. In its usage, the carpenter employs his shoulder, full arm and wrist; all working together to strike the nail a blow with the hammer head. At the moment that a blow is struck to drive a nail fully into the work, the carpenter's hand gripping the hammer handle, due to the configuration of the hammer, comes close to the board or panel on which he is working. Consequently, it is not infrequent that the knuckles of the carpenter's gripping hand will hit the surface of the work causing painful bruising of his knuckles.

It is the primary object of the present invention to provide a hammer which is so designed that the required blows for driving in nails is accomplished without shoulder and full arm usage, and mainly by the worker's lower arm muscle and lessened wrist movement. This enables a greater control of the working movement of the hammer head and greater accuracy in its striking action on nails.

A further object of the invention is to provide a carpenter's hammer which is designed to minimize the possibility of the worker's knuckles coming into contact with the work during usage of the hammer.

Other objects and advantages, as well as the novel features of construction and manner of use of my improved hammer will become apparent from a perusal of the following description, when read in connection with the accompanying drawings, in which.

Figure 1:
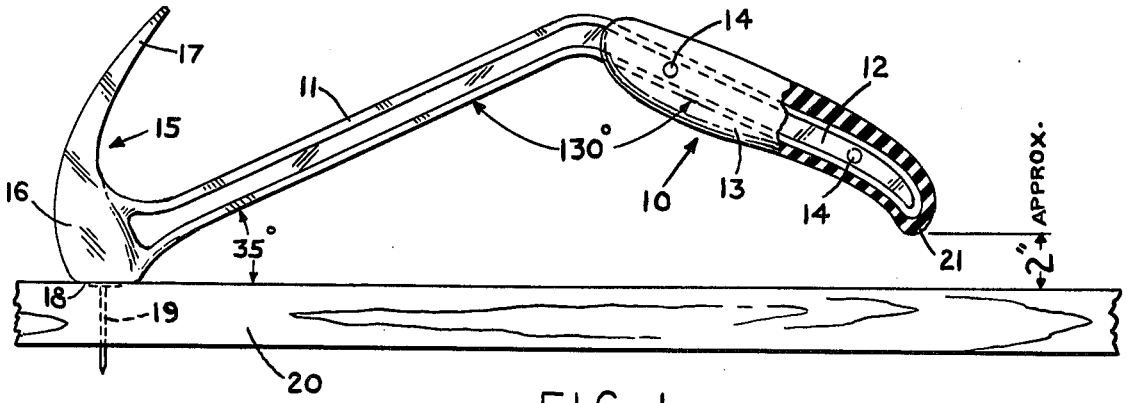
FIG. 1 is a side elevational view of my hammer when in use to drive a nail home into a board; the user's hand grip being omitted and the handle being partially broken away to show the construction of the hammer's handle more clearly.

In the drawings, the handle is shown to be composed of two angularly disposed parts, an outer handle portion generally designated 10 and an inner handle portion 11. The outer handle portion 10 is composed of an elongated member 12 which at its inner end is united to one end of the inner handle portion 11. It is preferred that the angular relation between handle portion 11 and member 12 be about 130° although this angle may vary through a range of plus or minus ten degrees depending on the particular usage for which a hammer is designed. Further, the connection between handle portion 11 and the member 12 may be curved instead of the sharp angularity illustrated. It is also contemplated that the handle portion 11 and member 12 be themselves curved so that the handle as a whole is curved so that its configuration generally resembles that of the angular relation illustrated. Mounted on member 12 is a grip 13 configured to enable the worker to obtain a firm grasp of the hammer and which may be made of any suitable material such as highly compressed rubber. The grip 13 may be secured to member 12 in any suitable fashion as by the studs 14 which may be integral with or secured to the member 12 in a manner known to the art.

Mounted on the other end of handle member 11 is a head 15 having a solid body 16 of any suitable configuration and from the upper end of which extends a known elongated prong or the customary claws 17 of any conventional form, such as the curved claws illustrated. The striking surface 18 of the hammer head may have an area of any conventional shape and is disposed to the handle portion 11 at an acute angle of approximately 35°. It is intended that if a plane parallel to the striking surface 18 is passed through the point of intersection of the longitudinal center lines of the handle portions 11 and 12 and a line perpendicular to such plane is passed through such point of intersection, the aforesaid angle of 130° will be divided into two angles 55° and 75°; the angle of 55° being between such perpendicular line and the center line of the handle portion 11 and the angle of 75° being between the perpendicular line and the center line of the handle portion 12.

It is preferred that the hammer head 15, the handle portion 11 and the handle member 12 be formed of metal in one piece, although the handle porton 11 and member 12 may be made in one piece separate from the head 15 and joined to the head 15 in any suitable manner known to the art. The one piece handle portion 11 and member 12 may be made as a tubular extrusion or as a solid drop forged piece preferably of I-beam construction, as illustrated, in order that the handle may have maximum strength using a minimum of material.

As is shown more clearly in FIG. 1 of the drawings, the handle portion 11 is generally straight throughout its length and is angularly disposed to the body 16 of the head so that the longitudinal center line of such handle portion 11 is disposed at an angle of about 35° to the striking surface 18 of such head. Consequently, when a nail 19 is driven home into the work 20, the handle portion 11 will be disposed at an angle of 35° with the top or outer surface of such work. At such moment, the angular relation between the handle portion 11 and the handle portion 10, and the relation of the lengths of such portions 10 and 11 are such that the outer end of handle portion 10 will be approximately two inches from the top or outer surface of the work 20. Consequently, there is little likelihood of the worker's knuckles coming into contact with such outer surface of the work.

The lengths of the handle portions may be made approximately equal or the handle portion 11 may be made slightly longer than the handle portion 10 as illustrated. Whatever relation of lengths of the two portions are selected for a particular use of the hammer, the angular relations between such portions and between portion 11 and the striking face 18 are selected so that when the striking face 18 of the head rests on the surface of the work, the outer end of handle portion 10 will be spaced a given distance from such work surface. In order that the possibility of the worker's hand coming into contact with the work during the usage of the hammer may be entirely eliminated, the outer end of the handle portion 10 beyond the portion thereof grasped by the worker is turned downwardly to provide a protective blocking element 21, as shown in FIG. 1 of the drawings. Thus, if the outer end of the handle portion 10 should strike the outer surface 20 in the use of the hammer, the blocking element 21 would prevent the worker's hand from coming into contact with such surface. As shown more clearly in FIG. 1, the protection afforded by the blocking element 21 may be enhanced by shaping both the outer ends of the member 12 and the grip 13 to form such element 21. The blocking element 21 has a further advantage in that by reason of its hooked configuration it lessens the likelihood of the hammer flying out of the worker's hand during usage.

Figure 2:
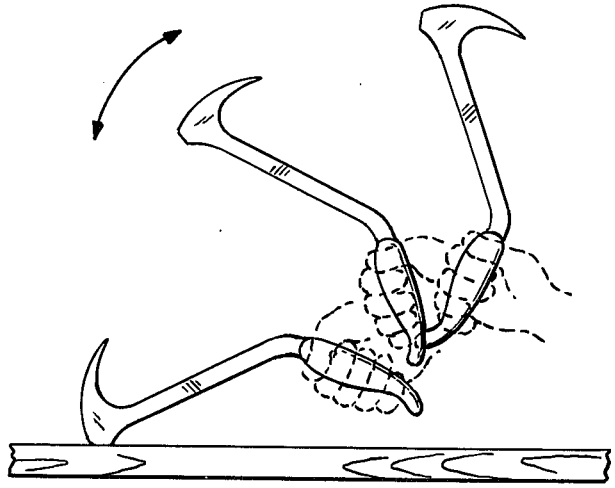
FIG. 2 is a diagrammatic view showing the movements of the hammer as it is moved to strike the blow shown in FIG. 1.

FIG. 2 of the drawings illustrates the manner in which the various parts of the worker's arm cooperate to produce the required striking force by the hammer of this invention. It will be observed that as the hammer is raised and swung downwardly to make a strike there is relatively little movement of the upper part of the arm and consequently of the shoulder of the worker. The principal movement of the worker's arm takes place below his elbow so that the downward swing of the hammer is accomplished mainly by the worker's lower arm muscles which are so employed that there is a more natural movement of the wrist than occurs in the use of the usual carpenter's hammer. It has been found that as a result of the hammer construction of this invention, such operation of the same provides a high degree of control in the movements of the hammer and a higher accuracy in its impact on the nail being driven into the work. Further, even though it takes less effort to work the hammer of this invention, when the hammer is swung downwardly the momentum of the head 15 will be greater that that obtained with the usual straight handled hammer, because of the angular relation of the hammer portions 10 and 11. As a result, the striking force of the head will be substantially greater than that of the usual straight handled hammer.

Figure 3:
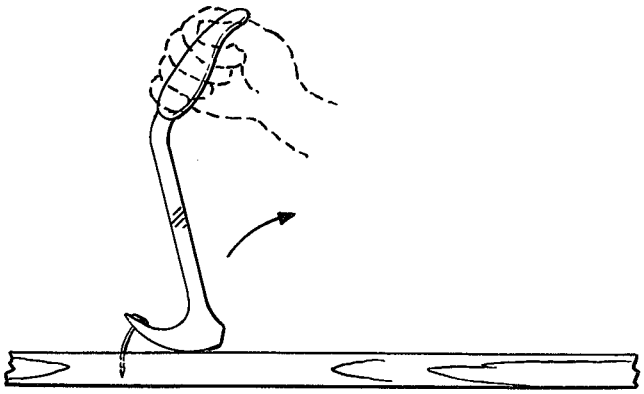
FIG. 3 is a side elevational view indicating the leverage applied when the hammer is employed to remove a nail from a work.

FIG. 3 of the drawings illustrates the increased pulling leverage that is effected by the hammer of this invention when it is employed in extracting nails from a work.

It will be evident from the foregoing description that changes in the form, proportion and construction of the parts of the hamer disclosed may be resorted to without departing from the spirit of the invention or the scope of the appended claims.

I claim:

1. A hammer comprising a rigid handle having mounted on one end a perpendicularly disposed head having on one end thereof a flat work striking face, said rigid handle being composed of a straight outer portion having a grip for the user's hand that is spaced from the head and a straight inner portion between the head and the outer portion to which the head is attached, said inner and outer handle portions having given lengths and being generally angularly disposed relative to each other in one plane that is perpendicular to the work striking face, and said inner portion being generally angularly disposed in that plane relative to said striking face, the general angular relation between said handle portions, and the general angular relation between said inner portion and said work striking face, and the lengths of said handle portions all being such that the outer end of said outer handle portion is spaced a given distance from a plane containing said work striking face, in which the general angular relation between said inner and outer handle portions is approximately 130°, in which the general angular relation between said inner handle portion and said work striking face is approximately 35° and in which said given distance is approximately 2 inches and in which the outer end of said outer handle portion is hooked in said one plane toward said work striking face to provide a protective blocking element for the user's hand.

* * * * *